US007517234B2

(12) United States Patent
Akino

(10) Patent No.: US 7,517,234 B2
(45) Date of Patent: Apr. 14, 2009

(54) MICROPHONE CONNECTOR AND MICROPHONE WITH THE SAME

(75) Inventor: Hiroshi Akino, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 66 days.

(21) Appl. No.: 11/830,483

(22) Filed: Jul. 30, 2007

(65) Prior Publication Data

US 2008/0038946 A1 Feb. 14, 2008

(30) Foreign Application Priority Data

Aug. 11, 2006 (JP) ..... 2006-220442
Dec. 28, 2006 (JP) ..... 2006-355009

(51) Int. Cl.
*H01R 4/66* (2006.01)

(52) U.S. Cl. ..... 439/106

(58) Field of Classification Search ..... 439/106, 439/95

See application file for complete search history.

(56) References Cited

U.S. PATENT DOCUMENTS 7,104,844 B2 9/2006 Akino
7,168,965 B2 1/2007 Akino
2005/0148227 A1 7/2005 Akino
2005/0239305 A1* 10/2005 Akino ..... 439/106
2006/0046570 A1 3/2006 Akino

FOREIGN PATENT DOCUMENTS

JP 60-68781 5/1985

OTHER PUBLICATIONS

U.S. Appl. No. 11/690,398, filed Mar. 23, 2007, Hiroshi Akino.

* cited by examiner

*Primary Examiner*—Tho D Ta
(74) *Attorney, Agent, or Firm*—Oblon, Spivak, McClelland, Maier & Neustadt, P.C.

(57) ABSTRACT

To obtain a microphone connector and microphone, wherein in the state where a pin insert and a connector case are connected to each other with a screw, the mutual decentering between the pin insert and the connector case can be suppressed to an extremely small amount, and the attaching and detaching of the connector can be carried out smoothly, and there is no looseness in the state where the connectors are connected to each other. The microphone connector includes: a cylindrical connector case which is connected to a microphone and into which a microphone cable side connector is inserted; a pin insert fixed in the connector case; a setscrew that is screwed in the radial direction of the pin insert to connect the connector case and the pin insert to each other; and a spacer being interposed between the inner peripheral surface of the connector case and the outer peripheral surface of the pin insert, and preventing the connector case and the pin insert from decentering due to the connection of the connector case and the pin insert with a setscrew.

11 Claims, 7 Drawing Sheets

(RELATED ART)

MICROPHONE CONNECTOR AND MICROPHONE WITH THE SAME

BACKGROUND OF THE INVENTION

1. Field of the Invention

The present invention relates to a microphone connector in which a pin insert is incorporated into a connector case, and to a microphone with the same, wherein the structure of the microphone connector is designed so as to be able to reduce the decentering between the connector case and the pin insert.

2. Related Background of the Invention

The sound signals electroacoustically transduced by a microphone are output from a microphone body to the outside via a shielded balanced cable. The microphone and the shielded balanced cable can be attached and detached to/form each other via a three-pin type microphone connector, for example. As the microphone connector, for example, a standardized one, such as the connector defined by EIAJ RC-5236 "a latch-lock round connector for an audio system" is typically used.

The microphone side connector of the above-described standardized microphone connector is a male connector, wherein a pin insert is arranged in the connector case, and the pin insert and the connector case are connected to each other with a screw. FIG. 7 shows the example, wherein reference numeral 1 represents a connector case, reference numeral 5; a pin insert, and reference numeral 10; a screw, respectively. The connector case 1 is formed in such a shape that a portion corresponding to the bottom of a closed-end cylindrical metal case is punched to form a circular window hole 2 and also form an inward flange 4 around the window hole 2. The inward flange 4 forming end of the connector case 1 is connected to, for example, the rear end of a non-illustrated microphone. On the peripheral wall of the connector case 1, there is formed a round hole 3 for inserting a screwdriver for rotating a screw 10.

The pin insert 5 is inserted into the connector case 1. The pin insert 5 comprises a base 6 made of an insulating material, e.g., a molding resin, and connector pins 8, 9 that pass through the base 6 in the thickness direction and are integrally provided with the base 6. The base 6 is formed in such a cylindrical shape that the outer periphery thereof is along the inner periphery of the connector case 1 and a screw hole 7 is formed from the outer peripheral surface toward the center in the radial direction. Although two connector pins 8, 9 are illustrated in FIG. 7, there is provided another non-illustrated connector pin. The base 6 is located deep inside the connector case 1, i.e., in a position adjacent to the inward flange 4, and the screw 10 screwed into the screw hole 7 and the round hole 3 of the connector case 1 have a positional relationship corresponding to each other, so that a screwdriver can be inserted from the round hole 3 of the connector case 1 to rotate the screw 10. The screw 10 projects from the outer peripheral surface of the base 6 radially outwardly and a portion corresponding to the shoulder of the screw 10 is in contact with the inner peripheral surface of the connector case 1, and the outer peripheral portion on the opposite side of the insert portion of the screw 10 of the base 6 is pressed against the inner peripheral surface of the connector case 1, whereby the pin insert 5 is fixed in the connector case 1.

Three connector pins including the connector pins 8, 9 pass through the base 6 in the thickness direction, one end thereof (right end in FIG. 7) extends substantially parallel to the axis of the connector case 1 in the connector case 1, and the other end extends from the window hole 2 of the connector case 1 toward the outside of the connector case 1. The other ends of the three connector pins including the connector pins 8, 9 are electrically connected to a suitable circuit of the microphone such as a predetermined circuit pattern of a circuit board, for example. From the open end of the connector case 1, i.e., from the opposite side (right end in FIG. 7) of the side on which the base 6 is fixed, for example, a female connector provided at one end of a microphone cable is inserted, so that the above-described three connector pins fit into the electric contact points of the female connector to electrically connect the connectors to each other.

SUMMARY OF THE INVENTION

[Problems to be Solved by the Invention]

Since the conventional microphone connector such as the one described regarding FIG. 7 has such a structure that the pin insert 5 is inserted in the connector case 1 and the pin insert is fixed to the connector case 1 with the screw 10, the outer diameter of the base 6 of the pin insert 5 needs to be made smaller than the inner diameter of the connector case 1. For this reason, in the state where the screw 10 is pulled up from the base 6 of the pin insert 5, in other words, in the state where the screw 10 is projected radially outwardly to fix the pin insert 5, as shown in FIG. 7, a maximum of approximately 0.7 mm gap will be produced between the inner peripheral surface of the connector case 1 and the outer periphery of the base 6. The producing of this gap will produce an approximately 0.4 mm decentering between the connector case 1 and the pin insert 5, i.e., a deviation between the centers thereof, as shown in FIG. 7. If this decentering is small, there will be no major problems, but if the decentering increases, the cable can not be connected to the microphone. Alternately, even if they could be connected to each other, looseness is produced between the both connectors to cause a loose connection, thus posing a problem such as the generation of a contact noise. If the above-described decentering is reduced in such a manner that the gap may not be produced between the inner diameter of the connector case 1 and the outer diameter of the base 6 of the pin insert 5 in order not to cause such a problem, then the pin insert 5 may not be inserted into the connector case 1 or the insertion may be difficult, thus making the assembly difficult.

As a structure for dissolving the above problems, a sleeve, which is fitted into the gap formed between a receiving side connector body and a microphone side connector body, may be provided in the connector case of the microphone side connector body and this sleeve may be pressed by a spring provided in the connector case (for example, see Patent Document 1).

[Patent Document 1] Japanese Utility Model Application Laid-open No. 60-68781

The invention described in Patent Document 1 is an invention for obtaining stability between both connectors when the microphone side connector and the counterpart connector are connected to each other, and is not the invention, such as the present invention, which focuses on the inclination, decentering, and the like of a pin insert and attempts to eliminate these. Moreover, the invention described in Patent Document 1 also has a drawback that the number of required components increases, making the assembly troublesome.

The present invention has been made in order to dissolve the problems of the conventional microphone connector described above, and is intended to provide a microphone connector and microphone, wherein in addition to causing a gap to be produced between the outer peripheral surface of a pin insert and the inner peripheral surface of a connector case in order to facilitate the assembly, there is no mutual decentering between the pin insert and the connector case in the state where the pin insert and the connector case are connected to each other with a screw, or even if there was a decentering, the decentering can be suppressed to an extremely small amount, thus allowing for a smooth attachment and detachment of the connector, and further there is no looseness in the state where the connectors are connected to each other.

[Means for Solving the Problems]

According to the most important aspect of the present invention, a microphone connector includes; a cylindrical connector case which is connected to a microphone and into which a microphone cable side connector is inserted; a pin insert fixed in the connector case; a setscrew that is screwed in the radial direction of the pin insert to connect the connector case and the pin insert to each other; and a spacer being interposed between the inner peripheral surface of the connector case and the outer peripheral surface of the pin insert, and preventing the connector case and the pin insert from decentering due to the connection of the connector case and the pin insert are connected to each other with the setscrew.

It is preferable that the spacer be a partially arc-shaped member along the outer peripheral surface of the pin insert.

It is more preferable that the spacer, which is the partially arc-shaped member, include a wide portion projecting in the width direction of the spacer in an intermediate portion in the circumferential direction.

It is more preferable that the wide portion be provided at two locations in an intermediate portion of the spacer in the circumferential direction.

[Advantages of the Invention]

By connecting the connector case and the pin insert to each other with the setscrew, the pin insert attempts to decenter with respect to the connector case, but the decentering is prevented by the interposition of the spacer. The prevention of decentering facilitates the attachment and detachment of the cable side connector to/from the microphone connector. The interposition of the spacer eliminates the looseness of the pin insert with respect to the connector case, thereby allowing the loose connection and contact noise due to the looseness to be prevented.

When the spacer is a partially arc-shaped member along the outer peripheral surface of the pin insert, the gap between the outer peripheral surface of the pin insert and the inner peripheral surface of the connector case can be filled with the spacer.

By providing the wide portion in the intermediate portion of the partial arc-shaped spacer in the circumferential direction, a rotation of the pin insert with respect to the connector case can be prevented and an inclination of the pin insert with respect to the connector case can be prevented.

If the above-described wide portion is provided at two locations in an intermediate portion of the spacer in the circumferential direction, a rotation of the pin insert with respect to the connector case can be prevented more effectively.

DESCRIPTION OF THE PREFERRED EMBODIMENTS

Figure 7:
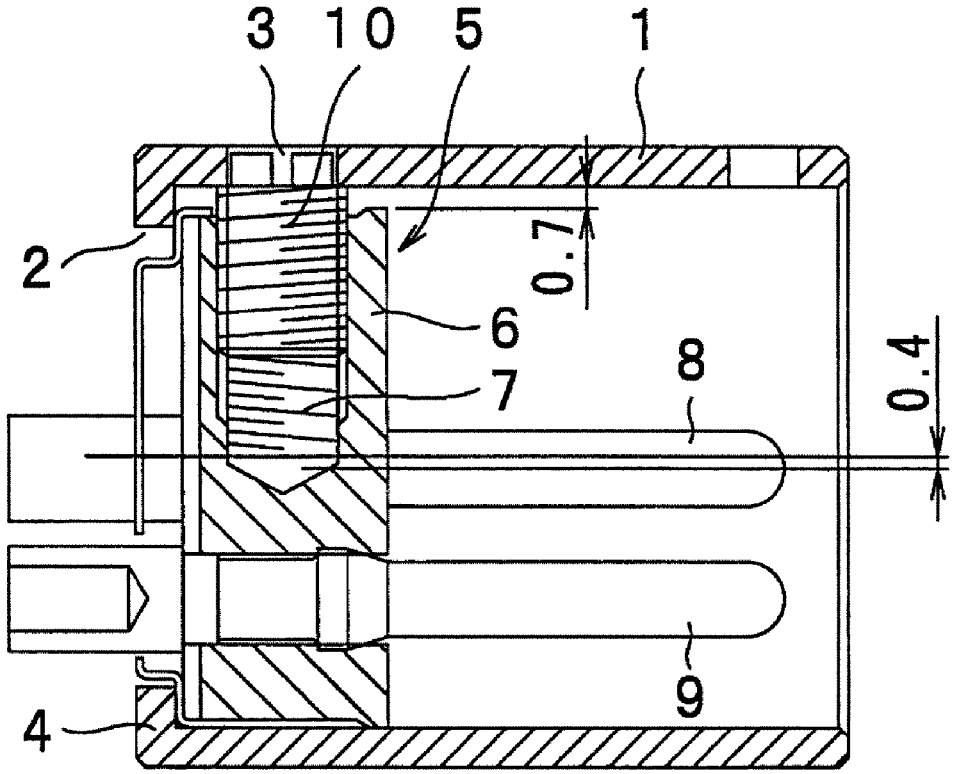
FIG. 7 is a vertical cross-sectional view showing an example of a conventional microphone connector.

Hereinafter, embodiments of a microphone connector and a microphone concerning the present invention will be described with reference to the accompanying drawings. The same reference numerals are given to the same components as those of the conventional example shown in FIG. 7.

Embodiment 1

Figure 1:
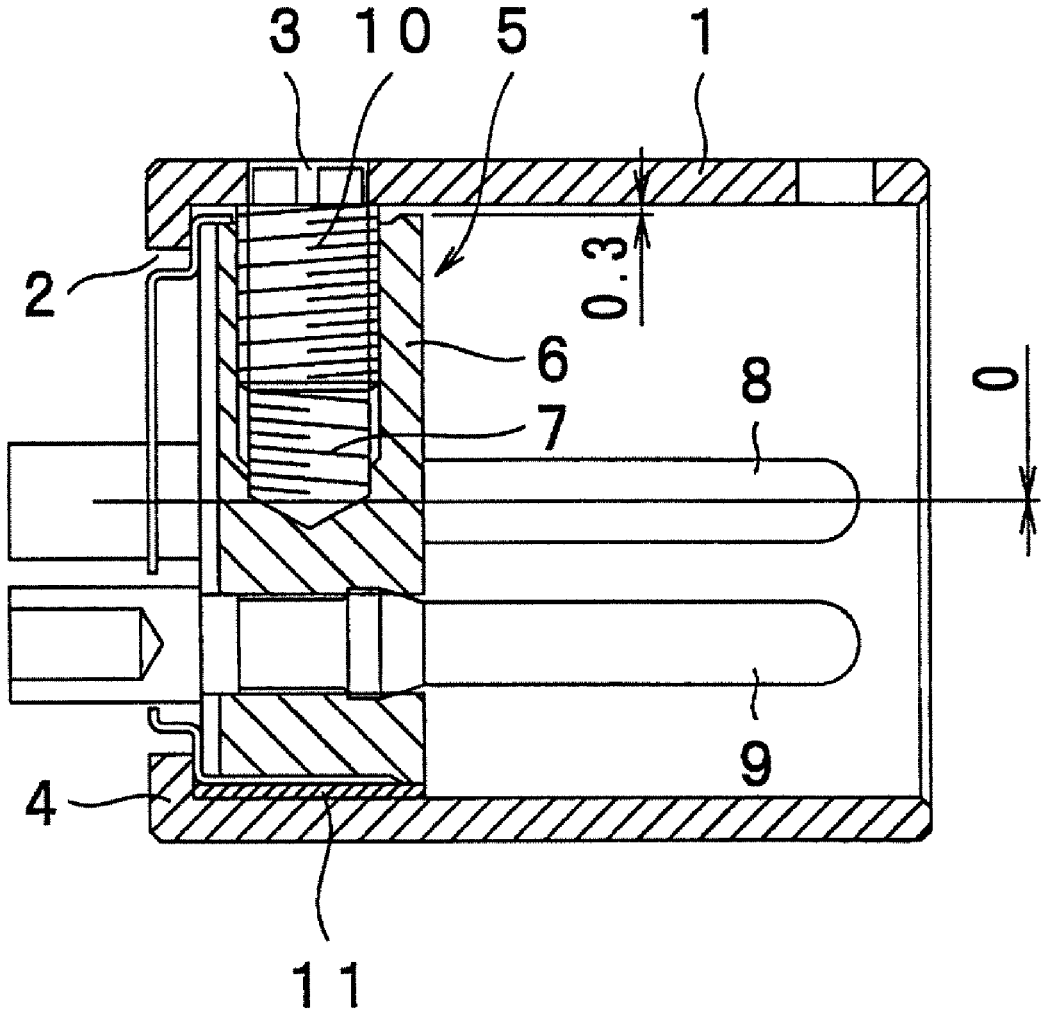
FIG. 1 is a vertical cross-sectional view showing an embodiment of a microphone connector concerning the present invention.

In FIG. 1, reference numeral 1 represents the connector case, reference numeral 5; the pin insert, and reference numeral 10; the screw, respectively. The connector case 1 is formed in such a shape that a portion corresponding to the bottom of a closed-end cylindrical metal case is punched to thereby form a circular window hole 2 and also form an inward flange 4 around the window hole 2. The inward flange 4 forming end of the connector case 1 is attached to the rear end of a non-illustrated microphone. In the peripheral wall of the connector case 1, there is formed a round hole 3 for inserting a screwdriver for rotating the setscrew 10.

The pin insert 5 is inserted into the connector case 1. The pin insert 5 comprises the base 6 made of an insulating material, e.g., a molding resin, and the connector pins 8, 9 that pass through the base 6 in the thickness direction and are integrally provided with the base 6. The base 6 is formed from a cylindrical face, whose outer periphery is along the inner periphery of the connector case 1, and the base 6 is in a low-height cylindrical shape as the whole base 6. A screw hole 7 is formed in the base 6 from the outer peripheral surface toward the center in the radial direction. Although two connector pins 8, 9 are illustrated in FIG. 1, there is provided another non-illustrated connector pin. The base 6 is located deep inside the connector case 1, i.e., in a position adjacent to the inward flange 4, and the setscrew 10 screwed into the screw hole 7 and the round hole 3 of the connector case 1 have a positional relationship corresponding to each other, so that a tool such as a screwdriver can be inserted from the round hole 3 of the connector case 1 to rotate the screw 10. The setscrew 10 projects from the outer peripheral surface of the base 6 radially outwardly, and a portion corresponding to the shoulder of the screw 10 is in contact with the inner peripheral surface of the connector case 1 (more precisely, the inner peripheral surface of the connector case 1 and also the peripheral portion of the round hole 3), and the outer peripheral portion on the opposite side of the insert portion of the screw 10 of the base 6 is pressed against the inner peripheral surface of the connector case 1, whereby the pin insert 5 is fixed in the connector case 1.

Three connector pins including the connector pins 8, 9 pass through the base 6 in the thickness direction, and one end (right end in FIG. 1) thereof extends substantially parallel to the axis of the connector case 1 in the connector case 1, and the other end extends from the window hole 2 of the connector case 1 toward the outside of the connector case 1 without contacting the inward flange of the connector case 1. The other ends of the three connector pins including the connector pins 8, 9 are electrically connected to a suitable circuit of a microphone, such as a predetermined circuit pattern of the circuit board, for example. From the open end of the connector case 1, i.e., from the opposite side (right end in FIG. 1) of the side on which the base 6 is fixed, for example, a female connector provided in one end of the microphone cable is inserted, so that the above-described three connector pins fit into the electric contacts of the female connector and both connectors are electrically connected to each other. The structure described hitherto is almost the same as that of the conventional example shown in FIG. 7.

Figure 2A:
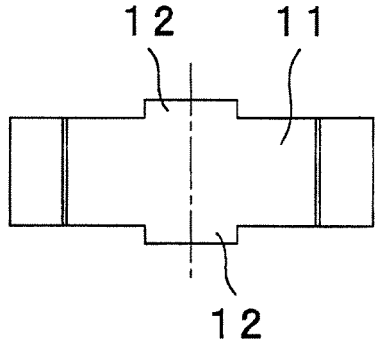
FIG. 2A is a plan view showing a spacer in the above-described embodiment.
Figure 2B:
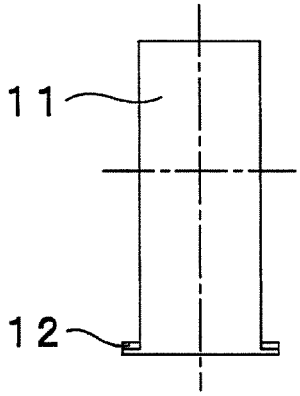
FIG. 2B is a side view of the above-described spacer.
Figure 2C:
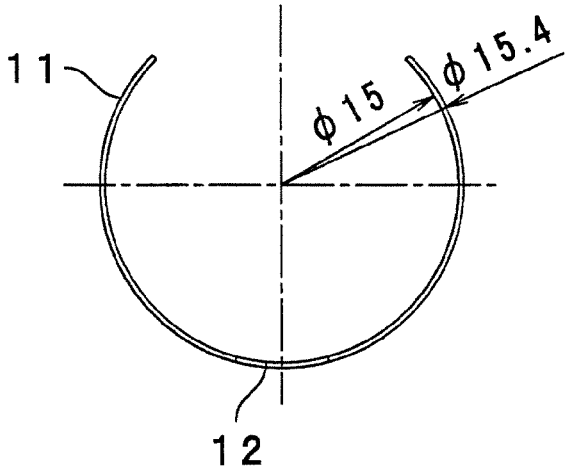
FIG. 2C is a front view of the above-described spacer.

In the peripheral portion on the opposite side of the insert portion of the screw 10 of the base 6, in other words, in the peripheral portion on the opposite side in the circumferential direction with respect to the contact portion between the setscrew 10 and the connector case 1, a spacer 11 is interposed between the peripheral portion and the inner peripheral surface of the connector case 1 which this peripheral portion faces. FIG. 2A, FIG. 2B, and FIG. 2C show the specific configuration of the spacer 11. As the spacer 11, for example, as shown in FIG. 2C, a plate of a thickness of approximately 0.4 mm being formed in a partially arc shape with the inner diameter of approximately 15 mm can be used. The spread angle of the partially arc-shaped spacer 11, i.e., the spread angle from one end to the other end with respect to the center of the arc, is preferably set equal to or more than 180 degrees, and is set to approximately 270 degrees in the illustrated example. The center portion of the spacer 11 in the circumferential direction is a wide portion 12 projecting at both sides in the width direction, and the center portion of the spacer 11 in the circumferential direction including this wide portion 12 is disposed so as to be located in the peripheral portion on the opposite side of the insert portion of the screw 10 of the base 6. The outer diameter of the base 6 is made smaller than the inner diameter of the connector case 1 so as to produce a maximum of approximately 0.7 mm gap between the inner peripheral surface of the connector case 1 and the outer peripheral surface of the base 6. The material of the spacer 6 is not limited. It may be made of metal, conductor or insulator.

As in the above-described embodiment, the spacer 11 is interposed between the inner peripheral surface of the connector case 1, and the outer peripheral surface of the pin insert 5, more precisely the outer peripheral surface of the base 6 of the pin insert 5, thereby preventing the pin insert 5 from decentering with respect to the connector case 1 due to the connection of the connector case 1 and the pin insert 5 with the setscrew 10. More specifically, in the state where the pin insert 5 is inserted in the connector case 1, if the setscrew 10 is rotated to be pulled up and projected from the base 6 of the pin insert 5 radially outwardly, and a portion corresponding to the shoulder of the setscrew 10 is brought into contact with the inner peripheral surface of the connector case 1, then a force to move the base 6 in the opposite direction of the projection direction of the setscrew 10 will work. However, the interposition of the spacer 11 prevents the movement of the base 6 or limits the amount of movement, and as shown in FIG. 1, in a portion where the setscrew 10 is present, limits a gap produced between the inner peripheral surface of the connector case 1 and the outer peripheral surface of the base 6 to approximately 0.3 mm, thus making the gap in the whole circumferential direction uniform and allowing the relative decentering between the connector case 1 and the pin insert 5 to be set to substantially zero.

By eliminating the relative decentering between the connector case 1 and the pin insert 5, it is possible to solve the conventional problems, such as that the microphone cable side connector can not be connected to the microphone connector, or that the attaching and detaching operation cannot be carried out smoothly even if they could be connected to each other. Moreover, in the state where the cable side connector is connected to the microphone connector, looseness between the both can be eliminated and the generation of a contact noise due to the looseness can be also prevented. The spacer 11 is formed in a partially arc shape of 180 degrees or more, and the gap produced between the inner peripheral surface of the connector case 1 and the outer peripheral surface of the base 6 can be filled with the spacer 11 across 180 degrees or more, and therefore the pin insert 5 can be connected to the connector case 1 stably.

The spacer 11 has the wide portion 12 projecting at both sides in the width direction, in the center portion in the circumferential direction. The base 6 is pushed by the contacting between the portion corresponding to the shoulder of the setscrew 10 and the inner peripheral surface of the connector case 1, and the base 6 presses the center portion of the spacer 11 in the circumferential direction against the inner peripheral surface of the connector case 1, the spacer 11 having the wide portion 12. At this time, with the rotation of the setscrew 10, a rotational force (rotation moment) about the setscrew 10 will work on the base 6 and the spacer 11. The inner peripheral surface of the connector case 1, which the wide portion 12 is in contact with, is a cylindrical plane while the wide portion 12 of the base 6 attempts to draw a plane circle about the setscrew 10. For this reason, a resistance force with respect to the above-described rotational force occurs in the wide portion 12, and this force prevents the rotation of the base 6 and spacer 11, and thus the positional restriction on the base 6 and spacer 11 is made stably and surely. Accordingly, the object of the present invention can be achieved.

Embodiment 2

Figure 3:
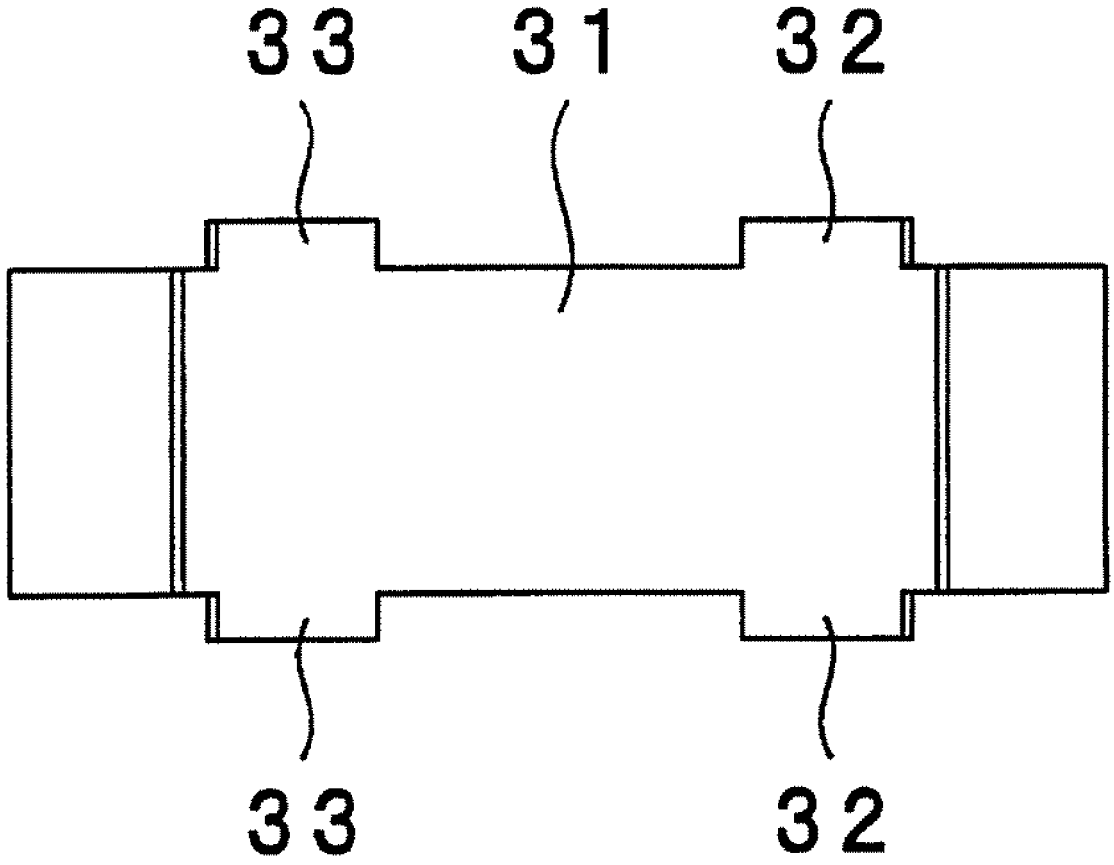
FIG. 3 is a plan view of a spacer used for an alternative embodiment of the microphone connector concerning the present invention.
Figure 4:
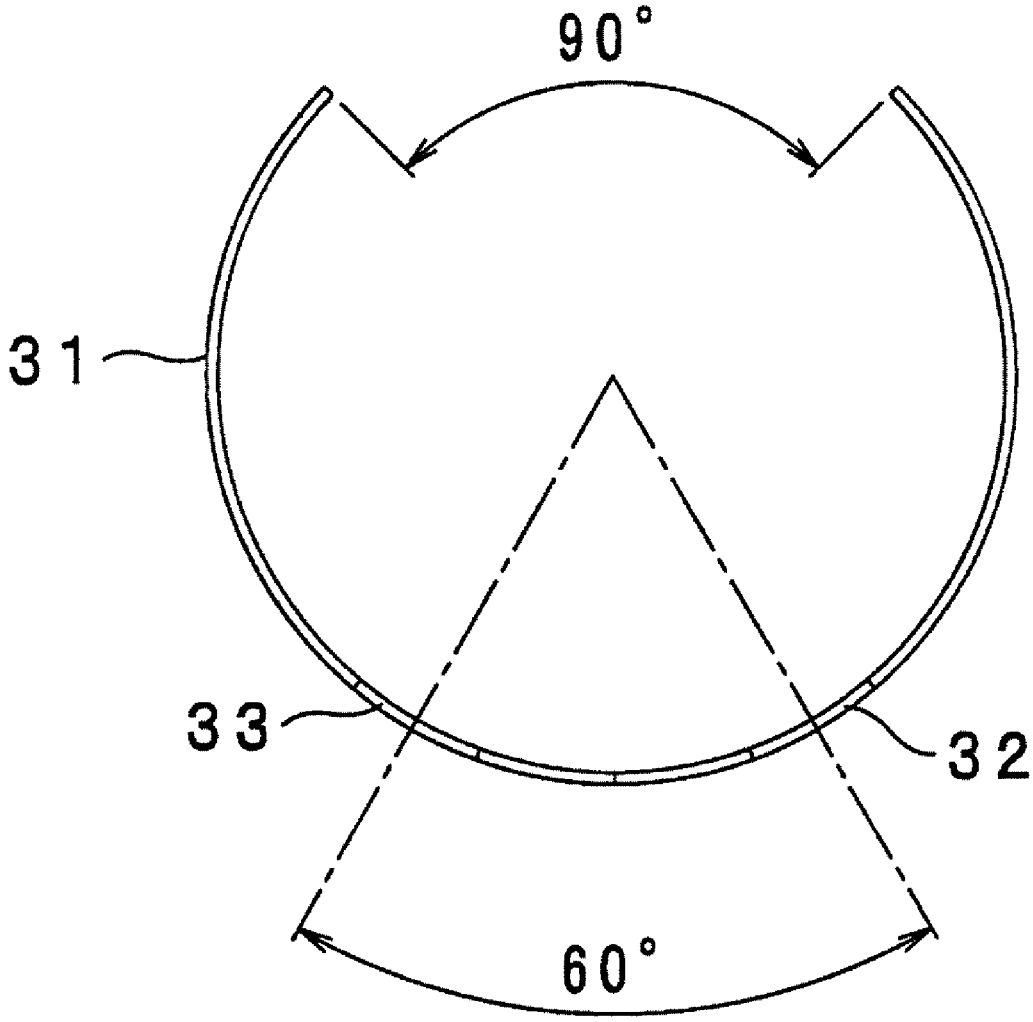
FIG. 4 is a front view of the above-described spacer.
Figure 5:
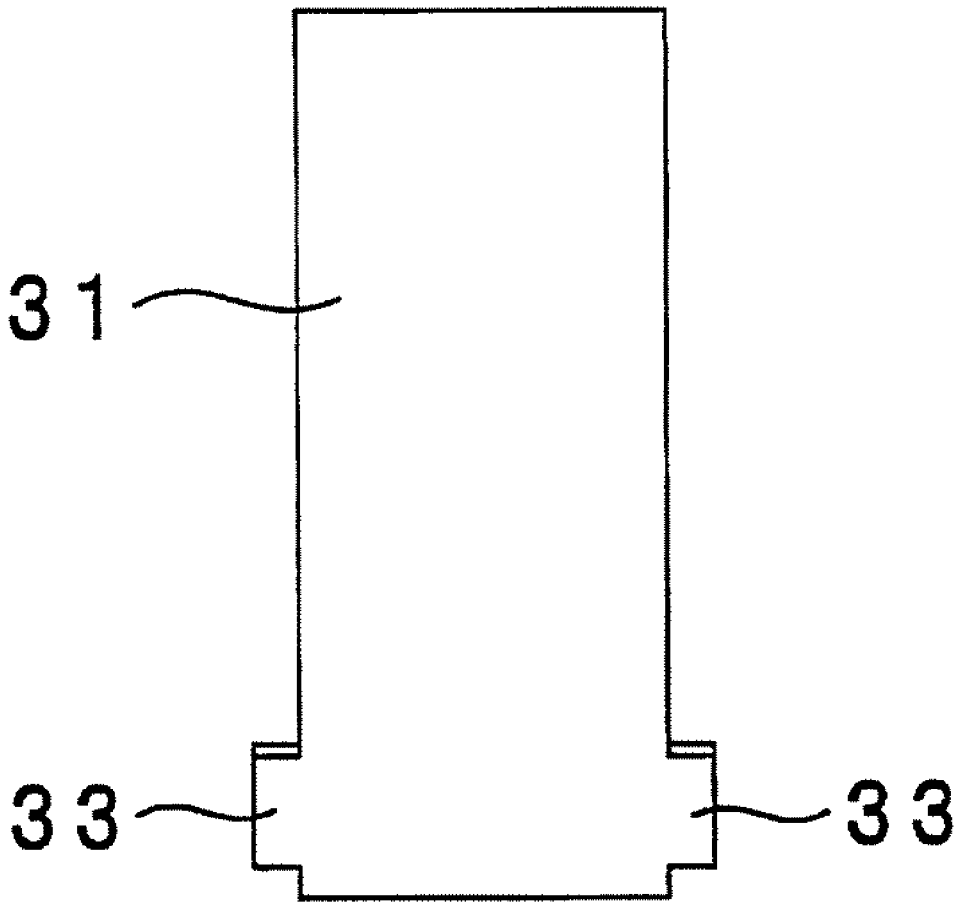
FIG. 5 is a left side view of the above-described spacer.

Next, a second embodiment of the microphone connector concerning the present invention will be described. Since the second embodiment features the structure of a spacer interposed between the inner peripheral surface of the connector case and the outer peripheral surface of the pin insert, the description is made focusing on the structure of the spacer. FIG. 3 to FIG. 5 show a spacer 31 used in the second embodiment. In FIG. 3 to FIG. 5, the spacer 31 is a plate-shaped material being formed in a partially arc shape like the spacer 11 in the first embodiment, and the difference from the spacer 11 in the first embodiment is that the spacer 31 has wide portions 32, 33 projecting at both sides in the width direction, at two locations in the circumferential direction of the spacer 31. The spread angle of the spacer 31, i.e., the spread angle with respect to the center of the arc from one end to the other end is set to 270 degrees, and accordingly the spread angle of the opening portion is set to 90 degrees. For two wide portions 32, 33, in the circumferential direction of the spacer 31, the spread angle between the centers of the respective wide portions 32, 33 is set to 60 degrees. Moreover, two wide portions 32, 33 are provided at positions the same distance and accordingly the same angle away from both ends in the circumferential direction of the spacer 31. The dimension of two wide portions 32, 33 in the circumferential direction and the projection dimension of the spacer 31 in the width direction are set to an appropriate dimension, respectively.

Like the spacer 11 in the first embodiment, the spacer 31 is arranged such that the center between the open ends in the circumferential direction may be in the position of the setscrew 10, and the spacer 31 is also arranged between the inner peripheral surface of the connector case 1 and the outer peripheral surface of the base 6 of the pin insert 5. In this arrangement, if the setscrew 10 is pulled up from the base 6, and the portion corresponding to the shoulder of the setscrew 10 is brought into contact with the inner peripheral surface of the connector case 1, more precisely the inner peripheral surface of the connector case 1 and also the peripheral portion of the round hole 3 of the connector case 1, then the outer peripheral surface on the opposite side of the position of the setscrew 10 of the base 6 will be pressed there against under the interposition of the spacer 31. Accordingly, the gap produced between the outer peripheral surface of the base 6 and the inner peripheral surface of the connector case 1 is filled with the spacer 31, and thus the decentering between the connector case 1 and the base 6 is dissolved or reduced.

Moreover, the spacer 31 has the wide portions 32, 33 at two locations in the circumferential direction, so when with the rotation of the setscrew 10, a rotational force about the setscrew 10 worked on the base 6 and the spacer 31, the wide portions 32, 33 are brought into contact with the inner peripheral surface of the connector case 1, the inner peripheral surface forming the cylindrical plane. At this time, a plane, on which the wide portion 32, 33 attempt to rotate, and the inner peripheral surface of the connector case 1, which these wide portions 32, 33 are in contact with, will intersect to interfere to each other, and the rotation of the base 6 caused by a rotation moment that acts on the base 6 due to the rotation of the setscrew 10 can be prevented, and the inclination of the base 6 with respect to the connector case 1 can be prevented. Since the wide portions 32, 33 project at both sides in the width direction of the spacer 31 and accordingly extend parallel to the axis of the base, the rotation of the base 6 due to the rotation moment can be prevented more effectively.

Embodiment 3

The embodiments of the microphone connectors shown in FIG. 1 to FIG. 5 have a configuration in which the setscrew 10 is pulled up from the base 6 of the pin insert 5 radially outwardly, whereby the setscrew 10 is brought into contact with the inner peripheral surface of the connector case 1 and the pin insert 5 is connected to the connector case, but the embodiments are not limited to such configuration.

For example, the setscrew 10 may be screwed into the base 6 of the pin insert 5, passing through the connector case 1, and the pin insert 5 and the connector case 1 may be connected to each other by drawing the base 6 toward the inner peripheral surface of the connector case 1 by means of the setscrew 10. In employing such a configuration, at a position where the base 6 of the pin insert 5 is drawn to the inner peripheral surface of the connector case 1 by means of the setscrew 10, i.e., at a position where the setscrew 10 is present, the spacer 11 is interposed between the pin insert 5 and the connector case 1. The spacer 11 is preferably provided with a hole which the setscrew 10 passes through.

Example 4

Figure 6:
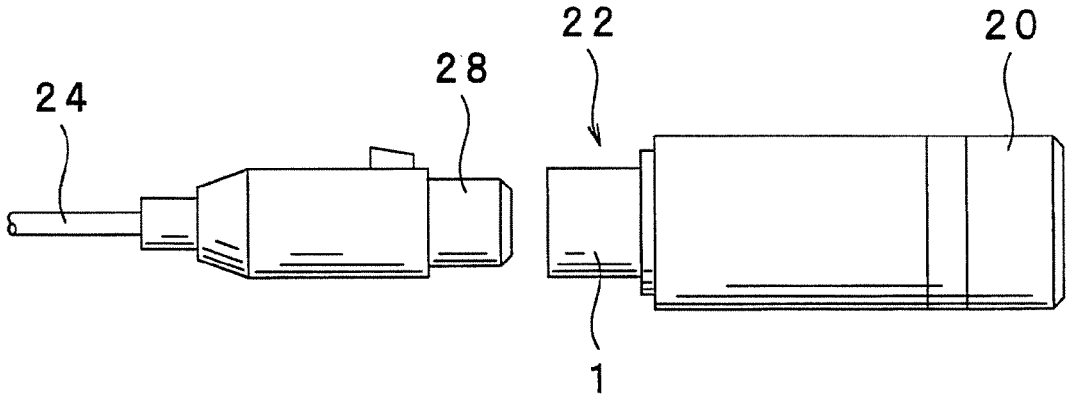
FIG. 6 is a side view showing an embodiment of a microphone concerning the present invention.

Next, an embodiment of a microphone provided with the microphone connector concerning the present invention will be described. In FIG. 6, a microphone 20 has, at the rear end portion, a microphone connector 22 including the connector case 1. The internal structure of the connector case 1 is the structure as already described. A microphone cable side connector 28 connected to one end of a microphone cable 24 is attached and detached to/from the microphone connector 22. The microphone cable side connector 28 is a female connector while the microphone connector 22 is a male connector. The tip end of the microphone cable side connector 28 is inserted into the connector case 1 of the microphone connector 22, and the connector pins 8, 9 and other connector pin, which the microphone connector 22 has, fit in the receiving hole formed in the tip end of the connector 28, so that the microphone connector 22 and the microphone cable side connector 28 are electrically connected to each other.

According to the embodiment of the microphone concerning the present invention, the microphone 20 is provided with the microphone connector 22 concerning the above-described embodiment, so the attachment and detachment of the microphone cable side connector 28 can be carried out smoothly, and also a looseness between the microphone connector 22 and the microphone cable side connector 28 can be eliminated, thus allowing prevention of the generation of a contact noise due to the looseness between these.

What is claimed is:

1. A microphone connector, comprising:

a cylindrical connector case which is connected to a microphone and into which a microphone cable side connector is inserted;

a pin insert fixed in the connector case;

a setscrew that is screwed in the radial direction of the pin insert to connect the connector case and the pin insert to each other; and a spacer being interposed between the inner peripheral surface of the connector case and the outer peripheral surface of the pin insert, and preventing the connector case and the pin insert from decentering due to the connection of the connector case and the pin insert with the setscrew.

2. The microphone connector according to claim 1, wherein the pin insert includes a base made of an insulating material, and a connector pin that passes through the base in the thickness direction and is integrally provided with the base.

3. The microphone connector according to claim 2, wherein the setscrew is screwed in the radial direction of the base and pulled up outwardly in the radial direction, and thereby the setscrew is in contact with the inner peripheral surface of the connector case and the pin insert is connected to the connector case.

4. The microphone connector according to claim 3, wherein the spacer is interposed between the inner peripheral surface of the connector case and the outer peripheral surface of the pin insert, on the opposite side in the circumferential direction with respect to the contact portion between the setscrew and the connector case.

5. The microphone connector according to claim 3, wherein in the peripheral wall of the connector case, there is formed a hole for inserting a tool for rotating the setscrew.

6. The microphone connector according to claim 2, wherein the setscrew is screwed into the base of the pin insert, passing through the connector case, and pulls in the base to the inner peripheral surface of the connector case to connect the pin insert and the connector case to each other.

7. The microphone connector according to claim 6, wherein at a position where the base of the pin insert is pulled in to the inner peripheral surface of the connector case by means of the setscrew, the spacer is interposed between the pin insert and the connector case.

8. The microphone connector according to claim 1, wherein the spacer is a partially arc-shaped member along the outer peripheral surface of the pin insert.

9. The microphone connector according to claim 8, wherein the spacer, which is the partially arc-shaped member, includes a wide portion projecting in the width direction of the spacer in an intermediate portion in the circumferential direction.

10. The microphone connector according to claim 9, wherein the wide portion is provided at two locations in an intermediate portion in the circumferential direction of the spacer.

11. A microphone provided with a microphone connector to/from which a microphone cable side connector is attached and detached, the microphone comprising the microphone connector according to any of claims 1 to 10 as the microphone connector.

* * * * *